US010172399B1

(12) United States Patent
Rivers

(10) Patent No.: US 10,172,399 B1
(45) Date of Patent: Jan. 8, 2019

(54) GLOVE WITH TRACK AND RAIL FOR SECURING A SMART PHONE THERETO

(71) Applicant: Myron Rivers, Randolph, MA (US)

(72) Inventor: Myron Rivers, Randolph, MA (US)

( * ) Notice: Subject to any disclaimer, the term of this patent is extended or adjusted under 35 U.S.C. 154(b) by 364 days.

(21) Appl. No.: 15/064,174

(22) Filed: Mar. 8, 2016

(51) Int. Cl.
*A41D 19/00* (2006.01)

(52) U.S. Cl.
CPC ..... *A41D 19/0037* (2013.01); *A41D 19/0024* (2013.01)

(58) Field of Classification Search
CPC ..... A41D 19/0037; A41D 19/0024; A41D 27/08; A41D 19/00; Y10T 24/1394; Y10T 24/3626; Y10T 24/45089; Y10T 24/45094; Y10T 24/4522; Y10T 24/4659; A45F 5/00; A45F 2200/0516
USPC ..... 455/575.6; 248/220.21, 223.41
See application file for complete search history.

(56) References Cited

U.S. PATENT DOCUMENTS 244,949 A * 7/1881 Thurman ..... A41D 19/01 2/158
3,368,811 A * 2/1968 Finney ..... A63B 71/146 15/227
4,397,438 A * 8/1983 Chapman ..... E05B 19/00 248/229.16
4,414,692 A * 11/1983 Dzierson ..... A41D 19/0024 2/160
5,815,843 A * 10/1998 Brillhart, III ..... A41D 13/0012 2/247
6,044,153 A 3/2000 Kaschke
7,254,376 B2 8/2007 Park
8,306,582 B2 * 11/2012 Williams ..... A45F 5/02 455/550.1
2001/0044991 A1 * 11/2001 Graves ..... A44B 19/16 24/400
2004/0064870 A1 4/2004 Gold
2006/0203999 A1 9/2006 Mirzakhanov
2007/0083979 A1 4/2007 Daniels
2007/0178950 A1 * 8/2007 Lewis ..... H04B 1/385 455/575.6
2010/0124957 A1 * 5/2010 Williams ..... A45F 5/02 455/575.6
2011/0185472 A1 * 8/2011 Voravan ..... A41F 1/008 2/161.2
2012/0138647 A1 * 6/2012 Norling ..... A45F 5/00 224/267
2014/0073376 A1 3/2014 Alejandro
2015/0052660 A1 * 2/2015 Chapman ..... A45F 5/00 2/160

FOREIGN PATENT DOCUMENTS

CN 202489240 U 10/2012

* cited by examiner

*Primary Examiner* — Jameson Collier
*Assistant Examiner* — Jocelyn Bravo
(74) *Attorney, Agent, or Firm* — Kyle A. Fletcher, Esq.

(57) ABSTRACT

The glove with track and rail for securing a smart phone thereto includes a fingerless glove that has a track integrated onto an outer surface. The track enables a rail member to attach thereon, and slide along the track. The rail member includes a fastening member that is adapted to secure an object thereon such that the object is able to slide along the track while said fingerless glove is being worn. The object is ideally a smart phone. The track extends linearly across the palm and portions of a back of hand of the fingerless glove such that the object is adapted to be positioned at any locale along the track.

12 Claims, 5 Drawing Sheets

GLOVE WITH TRACK AND RAIL FOR SECURING A SMART PHONE THERETO

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of gloves, more specifically, a glove with a track integrated onto an exterior surface onto which a smart phone is able to slide thereon.

SUMMARY OF INVENTION

The glove with track and rail for securing a smart phone thereto includes a fingerless glove that has a track integrated onto an outer surface. The track enables a rail member to attach thereon, and slide along the track. The rail member includes a fastening member that is adapted to secure an object thereon such that the object is able to slide along the track whilst said fingerless glove is being worn. The object is ideally a smart phone. The track extends linearly across the palm and portions of a back of hand of the fingerless glove such that the object is adapted to be positioned at any locale along the track.

These together with additional objects, features and advantages of the glove with track and rail for securing a smart phone thereto will be readily apparent to those of ordinary skill in the art upon reading the following detailed description of the presently preferred, but nonetheless illustrative, embodiments when taken in conjunction with the accompanying drawings.

In this respect, before explaining the current embodiments of the glove with track and rail for securing a smart phone thereto in detail, it is to be understood that the glove with track and rail for securing a smart phone thereto is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the glove with track and rail for securing a smart phone thereto.

It is therefore important that the claims be regarded as including such equivalent construction insofar as they do not depart from the spirit and scope of the glove with track and rail for securing a smart phone thereto. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
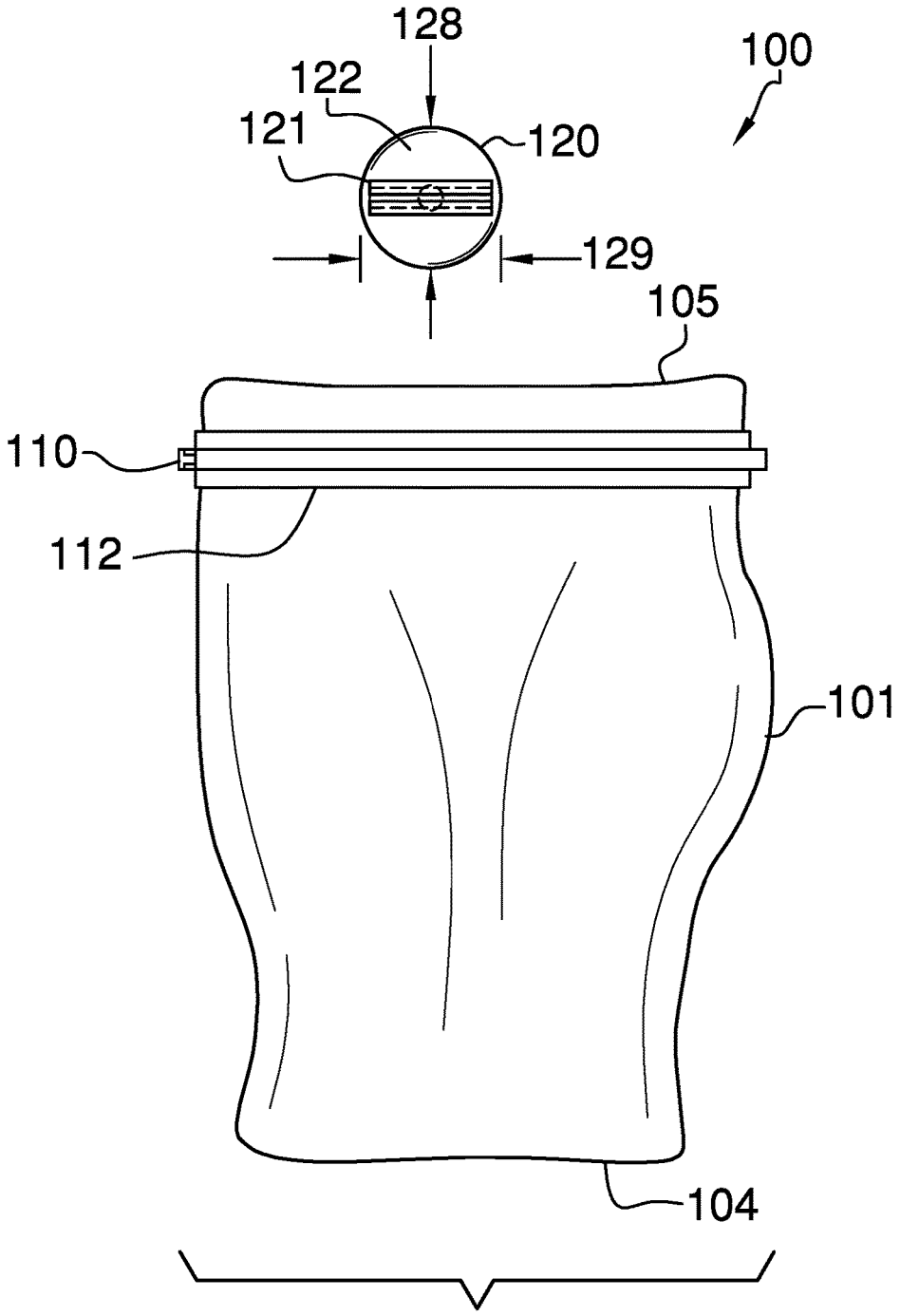
FIG. 1 is a top view of an embodiment of the disclosure.
Figure 2:
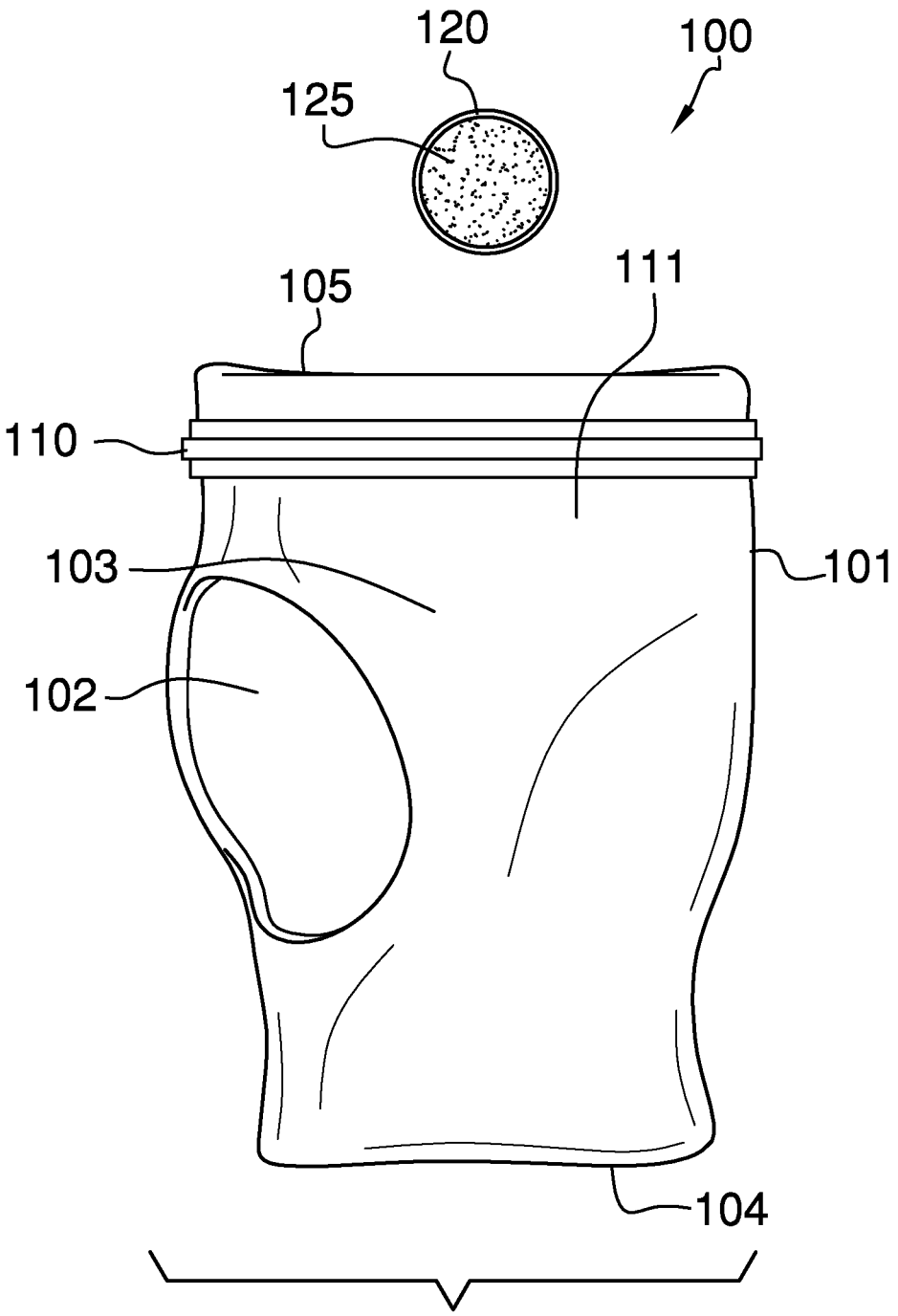
FIG. 2 is a bottom view of an embodiment of the disclosure.
Figure 3:
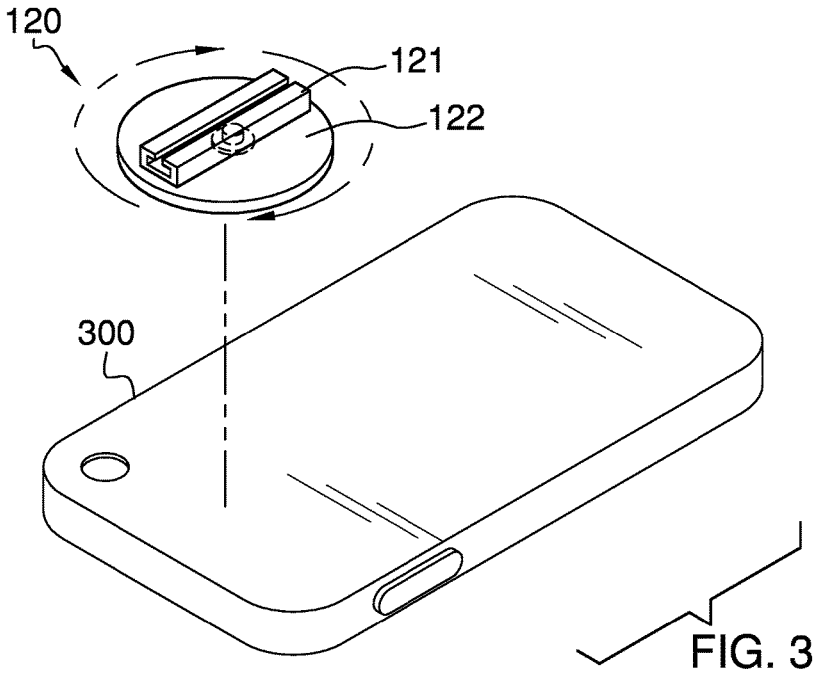
FIG. 3 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 6. The glove with track and rail for securing a smart phone thereto 100 (hereinafter invention) comprises a fingerless glove 101 that is further defined with an inner surface 102 and an outer surface 103. The fingerless glove 101 is further defined with an inlet 104 and a finger outlet 105. The inlet 104 is adapted to receive a hand 200 of a user. Fingers 201 of a hand 200 extend through the finger outlet 105. The fingerless glove 101 is further defined with a thumb opening 106. The thumb opening 106 is adapted to receive a thumb 202 of the hand 200. The fingerless glove 101 is made of a material that is flexible, and comprises a fabric, rubber, latex, leather, polyester, etc.

Figure 4:
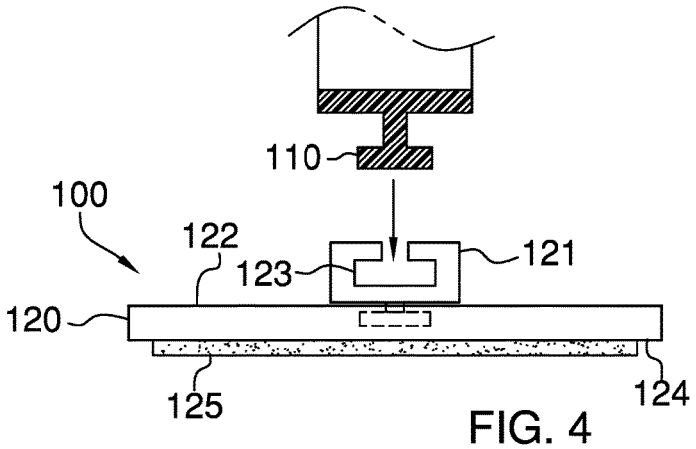
FIG. 4 is a detail view of an embodiment of the disclosure.
Figure 5:
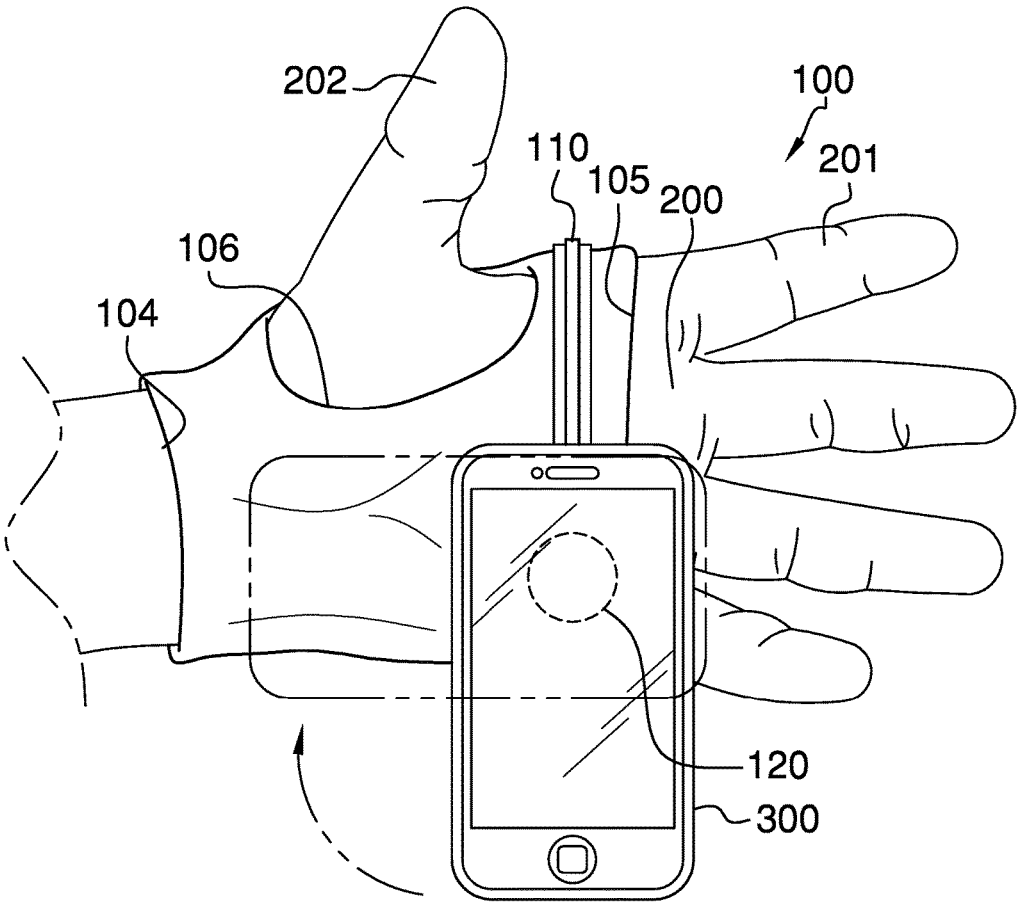
FIG. 5 is an in use view of an embodiment of the disclosure.

The outer surface 103 includes a track 110 thereon. The track 110 is linear, and extends across a palm surface 111 of the fingerless glove 101. Moreover, the track 110 extends across portions of a back of hand surface 112 of the fingerless glove 101. Referring to FIG. 4, the track 110 has a "T"-shaped cross section, and enables a rail member 120 to attach and slide along the track 110. The rail member 120 is a disc-shaped object with a rail coupler 121 on a front surface 122. The rail coupler 121 has a grooved opening 123 that corresponds with the "T"-shaped cross section of the track 110 such that the rail coupler 121 is able to slide along the track 110.

The rail member 120 is further defined with a rear surface 124 that includes a securing member 125 thereon. The securing member 125 is adapted to secure the rail member 120 to an object 300. It shall be noted that the term object 300 is being used to refer to any object, but is ideally suited for a smart phone. The object 300 should have a smooth flat surface onto which the securing member 125 is affixed. It shall also be noted that the securing member 125 is an adhesive, which adheres the rail member 120 to the object 300.

In use, the fingerless glove 101 is adapted to be worn on the hand 200. The rail member 120 is slideably engaged on the track 110. Moreover, the object 300 is adapted to be secured to the rail member 120 such that the object 300 is adapted to move along the track 110 of the fingerless glove 101 whilst the fingerless glove 101 is adaptively worn on the hand 200. It shall be noted that the track 110 is generally parallel with the finger outlet 105. Moreover, the track 110 is adjacent the finger outlet 105, and not the inlet 104. The rail member 120 is further defined with a diameter 128, which is greater than a coupler length 129 of the rail coupler 121. The coupler length 129 is ideally not more than 1 inch. The track 110 has a track length that is less than a fingerless glove 101 circumference, which is not depicted in the Figures, but is implied to correspond with the outer surface 103 of the fingerless glove 101.

Figure 6:
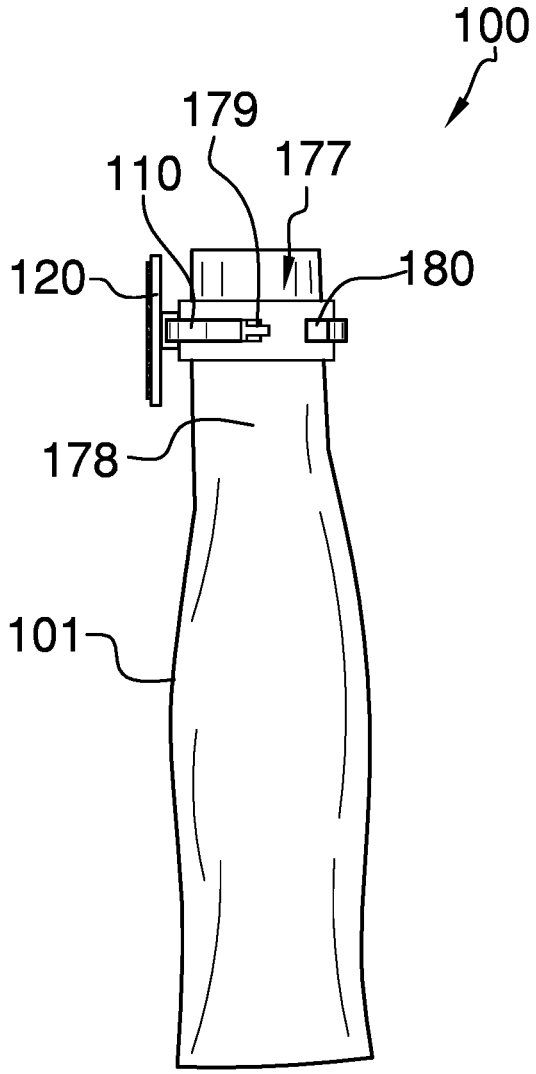
FIG. 6 is a side view of an embodiment of the disclosure.

Referring to FIG. 6, the track 110 does not encircle the fingerless glove 101. In fact, the track 110 features a track opening 177, which is depicted in FIG. 6. The track opening 177 is provided along a side 178 of the fingerless glove 101. The track 110 includes a track inlet 179 where the rail member 120 is able to be inserted onto and removed from the track 110 as needed. The track 110 also is further defined with a track stop 180, which prevents the rail member 120 from sliding off of the track 110. The track stop 180 is opposite of the track inlet 179. Both the track inlet 179 and the track stop 180 define the track opening 177.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A glove comprising:

a fingerless glove that includes a track onto which a rail member is slideably engaged;

wherein the rail member is adapted to be secured to an object such that when the fingerless glove is worn, the object is adapted to be slid along the track;

wherein the fingerless glove is further defined with an inner surface and an outer surface;

wherein the fingerless glove is further defined with an inlet and a finger outlet;

wherein the inlet is adapted to receive a hand;

wherein fingers of said hand are adapted to extend through the finger outlet;

wherein the fingerless glove is further defined with a thumb opening;

wherein the thumb opening is adapted to receive a thumb of the hand;

wherein the outer surface includes the track thereon;

wherein the track is linear, and extends across a palm surface of the fingerless glove;

wherein the track extends across portions of a dorsal surface of the fingerless glove;

wherein the track has a "T"-shaped cross section, and enables the rail member to attach and slide along the track;

wherein the rail member is disc-shaped with a rail coupler on a front surface;

wherein the rail coupler has a grooved opening that corresponds with the "T"-shaped cross section of the track such that the rail coupler is able to slide along the track.

2. The glove according to claim 1 wherein the fingerless glove is made of a flexible material that is selected from the group consisting of: fabric, rubber, latex, leather, and polyester.

3. The glove according to claim 1 wherein the rail member is further defined with a rear surface that includes a securing member thereon.

4. The glove according to claim 3 wherein the securing member is adapted to secure the rail member to said object.

5. The glove according to claim 4 wherein the object is a smart phone.

6. The glove according to claim 4 wherein the securing member is an adhesive, which adaptively adheres the rail member to the object.

7. The glove according to claim 6 wherein the track is generally parallel with the finger outlet.

8. The glove according to claim 7 wherein the track is adjacent to the finger outlet.

9. The glove according to claim 8 wherein the rail member is further defined with a diameter, which is greater than a coupler length of the rail coupler; wherein the coupler length is not more than 1 inch.

10. The glove according to claim 9 wherein the track does not encircle the fingerless glove; wherein the track is further defined with a track opening.

11. The glove according to claim 10 wherein the track opening is provided along a side of the fingerless glove; wherein the track includes a track inlet where the rail member is able to be inserted onto and removed from the track as needed.

12. The glove according to claim 11 wherein the track is further defined with a track stop, which prevents the rail member from sliding off of the track; wherein the track stop is located opposite to the track inlet; wherein both the track inlet and the track stop define the track opening.

* * * * *